US010622122B2

(12) United States Patent
Kinoshita et al.

(10) Patent No.: US 10,622,122 B2
(45) Date of Patent: Apr. 14, 2020

(54) CHIP RESISTOR AND METHOD FOR PRODUCING SAME

(71) Applicant: Panasonic Intellectual Property Management Co., Ltd., Osaka (JP)

(72) Inventors: Yasuharu Kinoshita, Fukui (JP); Takaaki Tamura, Fukui (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/321,491

(22) PCT Filed: Nov. 30, 2017

(86) PCT No.: PCT/JP2017/042982

§ 371 (c)(1),
(2) Date: Jan. 29, 2019

(87) PCT Pub. No.: WO2018/110288

PCT Pub. Date: Jun. 21, 2018

(65) Prior Publication Data

US 2020/0051716 A1 Feb. 13, 2020

(30) Foreign Application Priority Data

Dec. 16, 2016 (JP) ..... 2016-243918

(51) Int. Cl.
*H01C 1/14* (2006.01)
*H01C 17/00* (2006.01)
(Continued)

(52) U.S. Cl.
CPC ..... *H01C 1/14* (2013.01); *H01C 1/01* (2013.01); *H01C 7/00* (2013.01); *H01C 17/006* (2013.01)

(58) Field of Classification Search
CPC . H01C 17/02; H01C 1/14; H01C 1/02; H01C 1/028; H01C 1/034
See application file for complete search history.

(56) References Cited

U.S. PATENT DOCUMENTS 5,450,055 A * 9/1995 Doi ..... H01C 17/006 338/309
7,190,252 B2 * 3/2007 Smith ..... H01C 1/084 338/22 R (Continued)

FOREIGN PATENT DOCUMENTS

JP 2004-186541 7/2004

OTHER PUBLICATIONS

International Search Report of PCT application No. PCT/JP2017/042982 dated Feb. 27, 2018.

*Primary Examiner* — Kyung S Lee
(74) *Attorney, Agent, or Firm* — McDermott Will & Emery LLP

(57) ABSTRACT

An object of the present disclosure is to provide a chip resistor capable of suppressing degradation of long-term reliability, and a method for producing the chip resistor. The chip resistor of the present disclosure includes resistance member formed of metal, and a pair of electrodes respectively formed on both ends of first main surface of resistance member. The chip resistor further includes first protective film formed on second main surface located on a rear side of first main surface of resistance member, second protective film formed on first main surface of resistance member and between the pair of electrodes, and a third protective film formed on a side surface parallel to a direction of a current flowing between the pair of electrodes of resistance member. The side surface of resistance member is provided with a protrusion that protrudes outward when viewed along the current flowing direction.

6 Claims, 10 Drawing Sheets

(51) Int. Cl.
*H01C 1/01* (2006.01)
*H01C 7/00* (2006.01)

(56) References Cited

U.S. PATENT DOCUMENTS

| | | | | |
|---|---|---|---|---|
| 8,081,059 | B2 * | 12/2011 | Tanimura | H01C 1/148 338/307 |
| 9,396,849 | B1 * | 7/2016 | Wyatt | H01C 1/148 |
| 10,438,729 | B2 * | 10/2019 | Wyatt | H01C 1/034 |
| 2006/0097340 | A1 | 5/2006 | Tsukda et al. | |
| 2016/0133362 | A1 * | 5/2016 | Tsuda | H01C 7/003 338/322 |

* cited by examiner

CHIP RESISTOR AND METHOD FOR PRODUCING SAME

CROSS-REFERENCE TO RELATED APPLICATIONS

This application is a U.S. national stage application of the PCT International Application No. PCT/JP2017/042982 filed on Nov. 30, 2017, which claims the benefit of foreign priority of Japanese patent application 2016-243918 filed on Dec. 16, 2016, the contents all of which are incorporated herein by reference.

FIELD OF THE INVENTION

The present disclosure relates to a chip resistor that is used in various electronic devices and that uses a metal plate as a resistance member, and a method for producing the chip resistor.

DESCRIPTION OF THE RELATED ART

As illustrated in FIGS. 8 and 9, a conventional chip resistor of this type includes resistance member 1 formed of metal, a pair of electrodes 2 respectively formed on both ends of first surface 1*a* of resistance member 1, first protective film 3 formed on second surface 1*b* opposite to first surface 1*a* of resistance member 1, second protective film 4 formed on first surface 1*a* of resistance member 1 and between the pair of electrodes 2, and plated layers 5 respectively formed from exposed surfaces of the pair of electrodes 2 to end surfaces of resistance member 1. In addition, third protective films 6 are respectively provided on side surfaces 1*c* of resistance member 1.

A method for producing this chip resistor includes forming first protective film 3 on an entire surface of a rod-shaped resistance member, forming a plurality of electrodes at uniform intervals on another surface of the rod-shaped resistance member, forming second protective film 4 between adjacent electrodes and then respectively forming third protective films 6 on exposed side surfaces of the rod-shaped resistance member, and thereafter cutting and dividing the rod-shaped resistance member into individual pieces.

Note that PTL 1 has been known as prior art literature information related to the invention of the present application, for example.

CITATION LIST

Patent Literature

PTL 1: Unexamined Japanese Patent Publication No. 2004-186541

SUMMARY OF THE INVENTION

In the conventional chip resistor described above, third protective film 6 is formed on flat side surface 1*c* of resistance member 1. This degrades adhesive property between third protective films 6 and resistance member 1. Third protective film 6 is formed on the exposed side surface of the rod-shaped resistance member in an unassisted manner, and then the rod-shaped resistance member is cut. As a result, third protective film 6 tends to be peeled off from resistance member 1. Resistance member 1 is accordingly exposed from third protective film 6. This may degrade long-term reliability, which is problematic.

The present disclosure is provided to solve the above-described problem, and an object of the present disclosure is to provide a chip resistor capable of suppressing degradation of long-term reliability.

To achieve the above-described object, the present disclosure includes a protrusion that protrudes outward, when viewed along a direction in which a current flows in a side surface of a resistance member, on the side surface of the resistance member parallel to a direction of a current flowing between a pair of electrodes. A third protective film is configured to cover a side surface of the protrusion.

Both of a main surface and a rear surface located on a side opposite to the main surface of a sheet-shaped resistance member are etched to provide a plurality of grooves in the sheet-shaped resistance member. A protective member is formed inside the plurality of grooves and on the main surface of the sheet-shaped resistance member in an integrated manner. A plurality of electrodes are then formed between the grooves that are adjacent to each other at uniform intervals.

The protrusion is provided on the side surface of the resistance member. This configuration increases a contact area between the third protective film and the side surface of the resistance member. Furthermore, the protective member to be the first protective film and the third protective film is formed from the main surface of the resistance member to the inside of the grooves. This configuration allows the protective member to be filled inside the grooves. This prevents the third protective film from being peeled off. Therefore, the resistance member can be prevented from being exposed from the third protective film, thereby achieving an excellent effect of maintaining long-term reliability.

DETAILED DESCRIPTION OF THE PREFERRED EMBODIMENTS

An exemplary embodiment of a chip resistor and a method for producing the chip resistor according to the present disclosure will be described below with reference to the drawings.

(1) Chip Resistor

Figure 1:
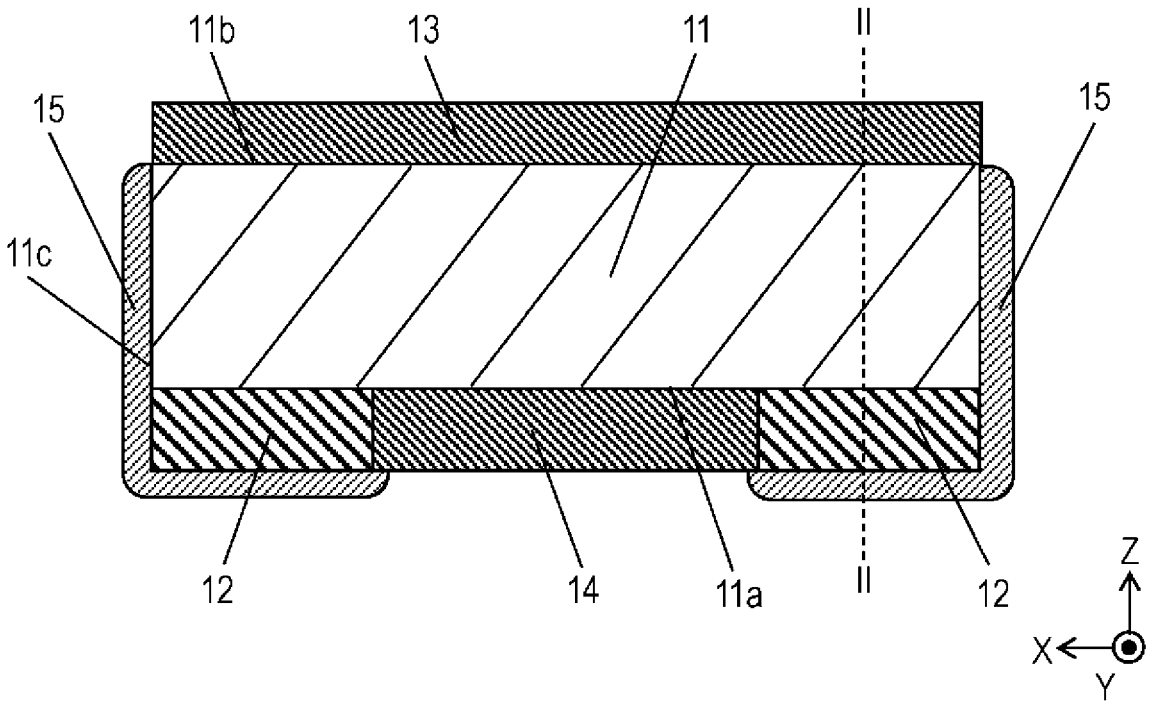
FIG. 1 is a side view of a chip resistor according to an exemplary embodiment.
Figure 2:
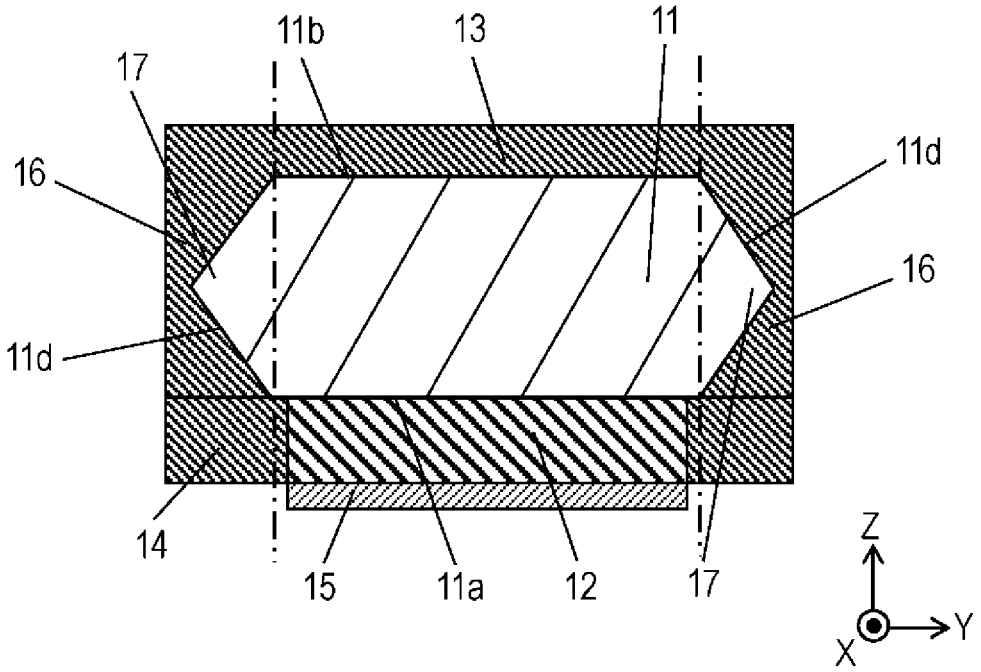
FIG. 2 is a cross-sectional view of the chip resistor.

FIG. 1 is a side view of the chip resistor according to the exemplary embodiment of the present disclosure. FIG. 2 is a cross-sectional view taken along line II-II in FIG. 1.

The chip resistor according to the exemplary embodiment of the present disclosure includes resistance member 11, electrodes 12, first protective film 13, second protective film 14, plated layer 15, and third protective film 16, as illustrated in FIG. 1 and FIG. 2. Resistance member 11 is formed of an alloy, for example, CuMnNi. Resistance member 11 includes first main surface 11*a*, second main surface 11*b* that is a rear surface of resistance member 11 when viewed from first main surface 11*a*, end surfaces 11*c*, and side surfaces 11*d*, end surfaces 11*c* and side surfaces 11*d* being located on respective lateral sides of resistance member 11. Electrodes 12 formed as a pair are formed of Cu, and are respectively formed on both ends of first main surface 11*a* of resistance member 11. Electrodes 12 as the pair are respectively disposed near two end surfaces 11*c*. Side surfaces 11*d* are disposed parallel to a line that connects electrodes 12 as the pair.

First protective film 13 is formed on second main surface 11*b* of resistance member 11. Second protective film 14 is formed on first main surface 11*a* of resistance member 11 and between the pair of electrodes 12. Each plated layer 15 is formed from an upper surface of electrode 12 to corresponding end surface 11*c* of resistance member 11. Third protective films 16 respectively cover side surfaces 11*d*.

In FIG. 1, an X-axis is provided such that a direction from a right end toward a left end of the paper is positive, and a Z-axis is provided such that a direction from a lower end toward an upper end of the paper is positive. A Y-axis is provided such that a direction toward a person who views the paper is positive. In FIG. 2, a Y-axis is provided such that a direction from a left end toward a right end of the paper is positive, and a Z-axis is provided such that a direction from a lower end toward an upper end of the paper is positive. In FIG. 2, an X-axis is provided such that a direction toward a person who views the paper is positive.

Upon operating, a current flows between the pair of electrodes 12 of resistance member 11. In other words, in FIG. 1, a current flows inside resistance member 11 along a direction parallel to the X-axis.

End surfaces 11*c* are parallel to a Y-Z plane, and side surfaces 11*d* are parallel to the X-axis.

Resistance member 11 has a substantially columnar shape that is long in a direction along the flowing current (X-axis-direction). Further, a cross-sectional shape of resistance member 11 when viewed from the direction along the flowing current (viewed from above the plane of drawing of FIG. 2) is a hexagon. In other words, resistance member 11 is provided with protrusions 17 respectively provided on side surfaces 11*d* thereof, and therefore has a hexagonal shape that is long along a direction orthogonal to the current flowing direction (Y-axis direction). Accordingly, resistance member 11 is a substantially hexagonal prism.

Protrusion 17 is a portion protruding outward from other portions on side surface 11*d* of resistance member 11, when viewed along the current flowing direction. In other words, protrusion 17 protrudes outward from a plane formed by connecting an edge of first main surface 11*a* and an edge of second main surface 11*b* (a plane parallel to the X-Z plane), along the direction orthogonal to the current flowing direction (Y-axis direction). In FIG. 2, protrusion 17 corresponds to a portion on an outer side of an alternate long and short dash line. Note that the alternate long and short dash line is a part of the plane formed by connecting the edge of first main surface 11*a* and the edge of second main surface 11*b*, which is described above. Side surface 11*d* of resistance member 11 having protrusion 17 is covered by third protective film 16.

Figure 10:
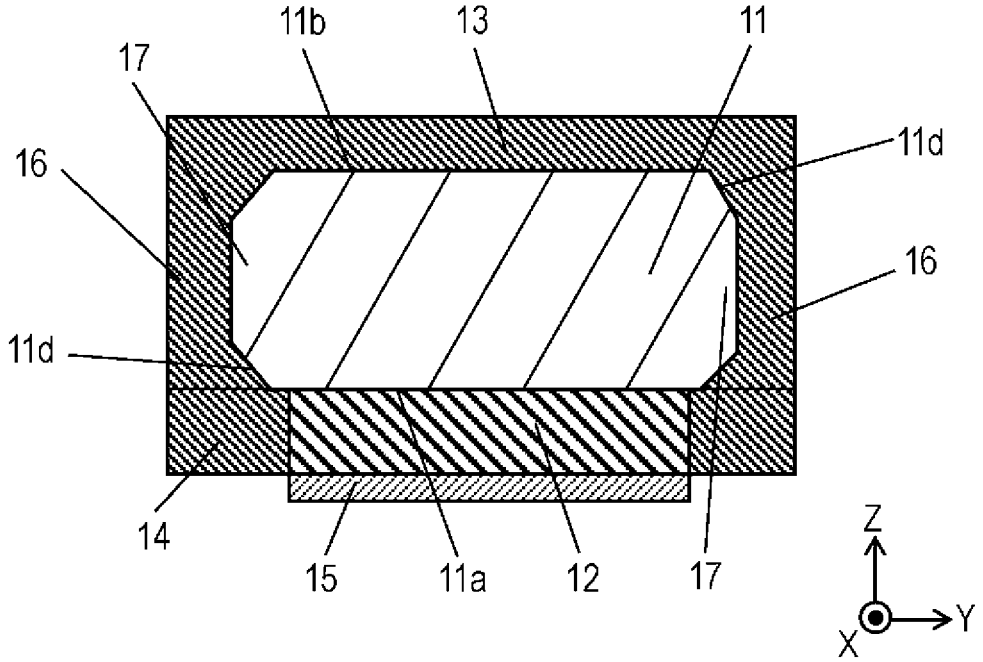
FIG. 10 is a cross-sectional view illustrating another example of the chip resistor according to the exemplary embodiment of the present disclosure.

Note that protrusion 17 may be sharply-pointed as illustrated in FIG. 2. Alternatively, as in a modification illustrated in FIG. 10, protrusion 17 may be configured such that side surface 11*d* partly includes a plane parallel to the current flowing direction.

Figure 11A:
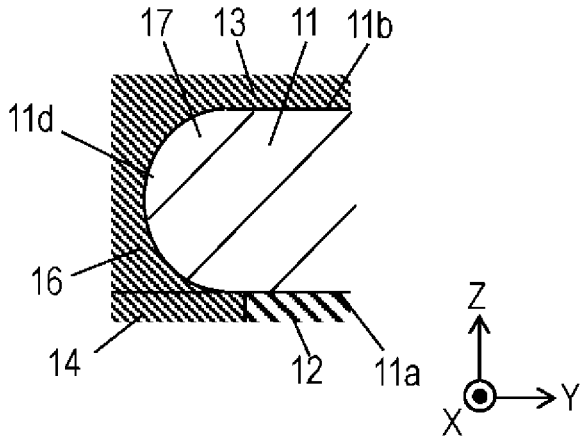
FIG. 11A is a cross-sectional view of a portion near a protrusion of another modification of the chip resistor according to the exemplary embodiment of the present disclosure.
Figure 11B:
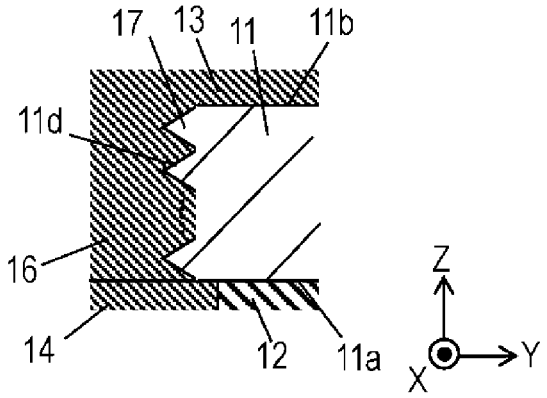
FIG. 11B is a cross-sectional view of a portion near a protrusion of yet another modification of the chip resistor.
Figure 11C:
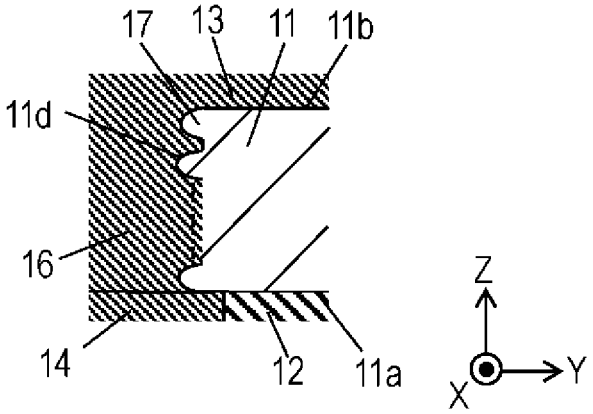
FIG. 11C is a cross-sectional view of a portion near a protrusion of yet another modification of the chip resistor.

Alternatively, protrusion 17 may have a hemispherical side-surface shape as in a modification illustrated in FIG. 11A, may have a plurality of triangular pyramidal projections as in a modification illustrated in FIG. 11B, or may have a plurality of hemispherical projections as in a modification illustrated in FIG. 11C. Protrusion 17 may have a columnar side-surface shape in place of the hemispherical side-surface shape described above. A shape of each of the plurality of projections serving as protrusion 17 may be a pyramid such as a quadrangular pyramid, a cone, a prism, or a column. Intervals between the plurality of projections can be selected as appropriate. When a plurality of protrusions 17 are provided, their shapes or sizes are not necessarily uniform, and may be arbitrary. Note that each of FIGS. 11A, 11B, and 11C is an enlarged cross-sectional view of a portion near protrusion 17 according to another modification of resistance member 11.

A metal constituting resistance member 11 may be a single metal, but may preferably be a CuMnNi alloy or a CuMnSn alloy whose temperature coefficient of resistance (TCR) is nearly zero, and whose Peltier effect is minimized.

Here, a surface formed with the pair of electrodes 12 (plated layers 15) is mounted on a mounting substrate (hereinafter, not illustrated). Note that a direction toward the pair of electrodes 12 to be mounted from the mounting substrate is defined as "upward", for convenience.

Hereinafter, dimensions of a completed chip resistor will be described with reference to FIG. 1. With respect to a size of the chip resistor, the chip resistor has a longitudinal length (Y direction) of 0.8 mm, a lateral length (X direction) of 1.56 mm, and a height (Z direction) of 0.3 mm. With respect to a size of resistance member 11, resistance member 11 has a longitudinal length (Y direction) of 0.6 mm, a lateral length (X direction) of 1.56 mm, and a height (Z direction) of 0.2 mm, and is formed of the CuMnNi alloy. The protrusion of resistance member 11 protrudes along the Y direction from the plane formed by connecting the edge of first main surface 11*a* and the edge of second main surface 11*b* by 0.02 mm. Each of the pair of electrodes 12 is formed of Cu, and with respect to its size, each of the pair of electrodes 12 has a longitudinal length (Y direction) of 0.33 mm, a lateral length (X direction) of 0.5 mm, and a thickness (Z direction) of 0.05 mm. An interval between mutually-facing ends of the pair of electrodes 12 is 0.56 mm. Thicknesses of first protective film 13, second protective film 14, and third protective film 16, being formed of an epoxy resin, are respectively 0.05 mm, 0.05 mm, and 0.1 mm. Plated layer 15 is formed of three layers of Cu, Ni, and Sn from a side closer to resistance member 11, and a total thickness is 0.018 mm.

Note that, those dimensions and materials are examples, and the chip resistor of the present disclosure is not necessarily limited to those dimensions and materials.

(2) Method for Producing Chip Resistor

Hereinafter, a method for producing the chip resistor according to the exemplary embodiment of the present disclosure will be described with reference to the drawings.

Figure 13:
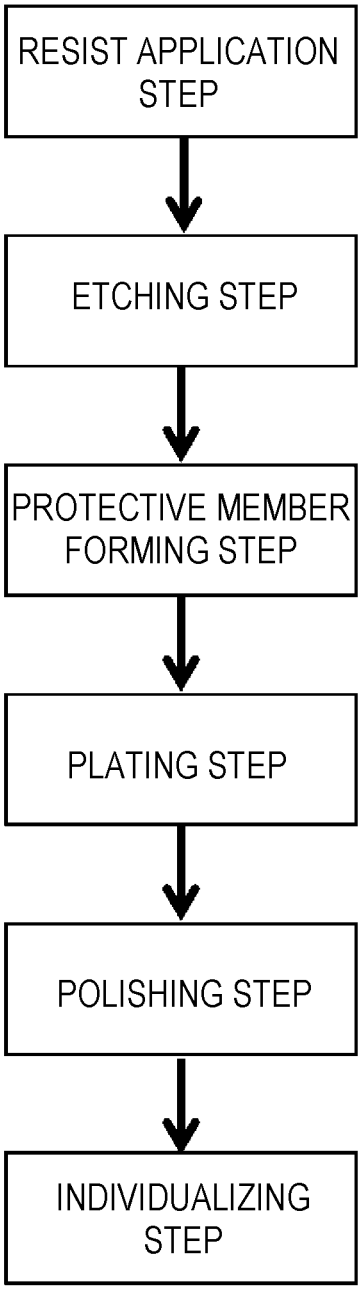
FIG. 13 is a flowchart illustrating a method for producing the chip resistor according to the exemplary embodiment of the present disclosure.

Note that, the method for producing the chip resistor is achieved by performing a resist application step, an etching step, a protective member forming step, plating step, polishing step, and an individualizing step in this order, as illustrated in a flowchart of FIG. 13.

(Resist Application Step)

Figure 3A:
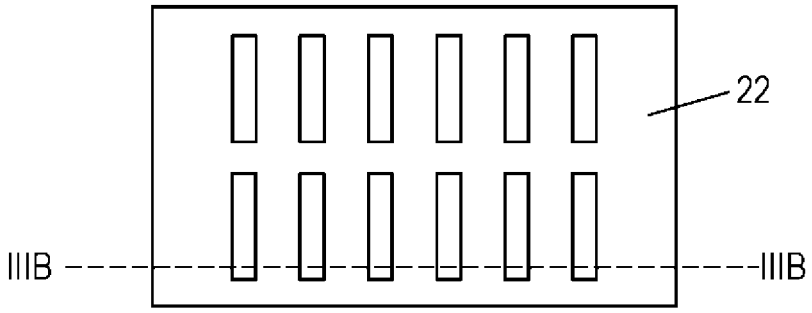
FIG. 3A is a top view indicating a resist application step in a method for producing the chip resistor.
Figure 3B:
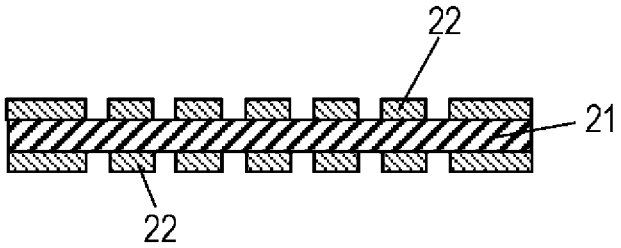
FIG. 3B is a cross-sectional view indicating the resist application step.

In the method for producing the chip resistor, a top view indicating the resist application step is illustrated in FIG. 3A, and a cross-sectional view indicating the resist application step is illustrated in FIG. 3B. Specifically, FIG. 3A is a top view of sheet-shaped resistance member 21 immediately after application of resist 22, and FIG. 3B is a cross-sectional view taken along line IIIB-IIIB in FIG. 3A.

First, as illustrated in FIG. 3A and FIG. 3B, sheet-shaped resistance member 21 is prepared in which an alloy formed of CuMnNi or the like is formed into a sheet shape, and resist 22 is pasted on both an upper surface and a lower surface of sheet-shaped resistance member 21. This resist 22 is formed such that openings in resist 22 are provided parallel to each other at uniform intervals. Openings in resist 22 on an upper-surface side and openings in resist 22 on a lower-surface side are formed to respectively overlap with each other, in plan view.

Note that, the upper surface of sheet-shaped resistance member 21 corresponds to first main surface 11*a* of resistance member 11. The lower surface of sheet-shaped resistance member 21 corresponds to second main surface 11*b* of resistance member 11. In other words, the upper surface and the lower surface of sheet-shaped resistance member 21 respectively correspond to a front surface and a rear surface of sheet-shaped resistance member 21.

(Etching Step)

Figure 3C:
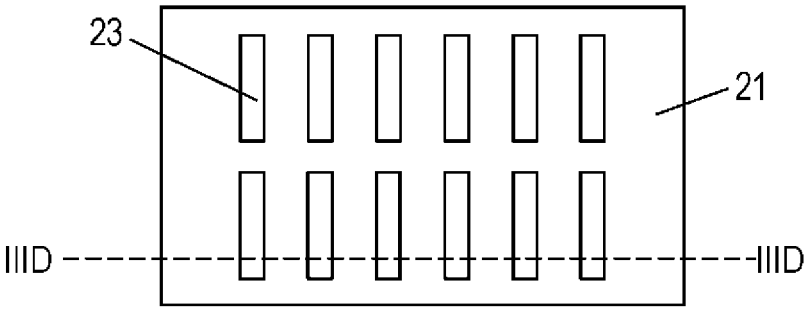
FIG. 3C is a top view indicating an etching step in the method for producing the chip resistor.
Figure 3D:
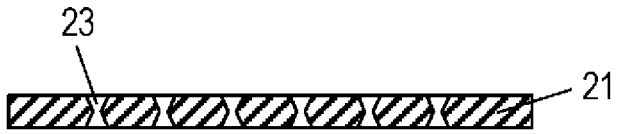
FIG. 3D is a cross-sectional view indicating the etching step.

In the method for producing the chip resistor, a top view indicating the etching step is illustrated in FIG. 3C, and a cross-sectional view indicating the etching step is illustrated in FIG. 3D. Note that FIG. 3D is a cross-sectional view taken along line IIID-IIID in FIG. 3C.

Next, as illustrated in FIG. 3C and FIG. 3D, the upper and lower surfaces of sheet-shaped resistance member 21 are etched to form a plurality of grooves 23 in sheet-shaped resistance member 21, and then resist 22 is removed. A portion between grooves 23 in sheet-shaped resistance member 21, being formed as an individual chip, corresponds to resistance member 11 of the chip resistor.

At this time, the etching is performed from both the upper surface and the lower surface, and hence protrusion 17 is formed on the side surface (inner surface of groove 23) of resistance member 11, as illustrated FIG. 2 and FIG. 3D. An upper portion and a lower portion of protrusion 17 are cutout portions upon etching. The etching is performed from both the upper surface and the lower surface, and hence, even in a case of thick resistance member 11, a shape of resistance member 11 can be processed with high accuracy. This improves the accuracy of a resistance value.

(Protective Member Forming Step)

Figure 4A:
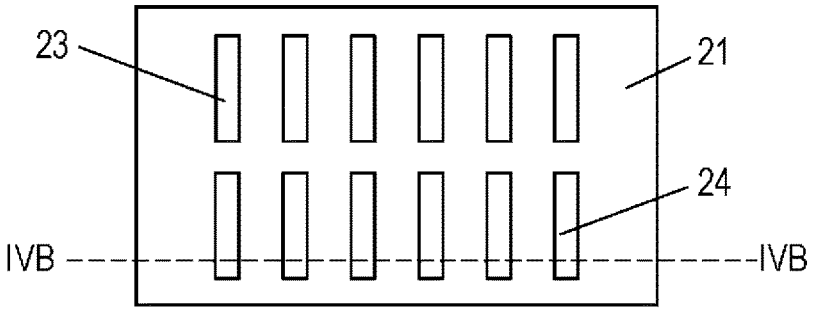
FIG. 4A is a top view indicating a protective member forming step in the method for producing the chip resistor.
Figure 4B:
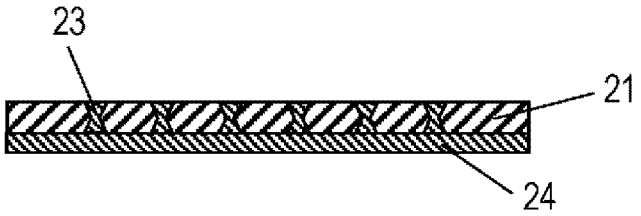
FIG. 4B is a cross-sectional view indicating the protective member forming step.

In the method for producing the chip resistor, a top view indicating the protective member forming step is illustrated in FIG. 4A, and a cross-sectional view indicating the protective member forming step is illustrated in FIG. 4B. Note that FIG. 4B is a cross-sectional view taken along line IVB-IVB In FIG. 4A.

Next, protective member 24 is simultaneously formed on the lower surface of sheet-shaped resistance member 21 and inside grooves 23, as illustrated in FIG. 4A and FIG. 4B. Protective member 24 is a film formed of an epoxy-based resin whose fluidity is increased by vacuum thermal pressing, thereby forming protective member 24 on the lower surface of sheet-shaped resistance member 21. Protective member 24 is also filled inside grooves 23. Protective member 24 is then cured. As a material of protective member 24, an epoxy resin containing silica and carbon black can be a main raw material, for example.

Note that, when sheet-shaped resistance member 21 is formed into individual pieces, protective member 24 at a portion on the lower surface of sheet-shaped resistance member 21 serves as first protective film 13 of the chip resistor, and protective member 24 at a portion filled inside groove 23 serves as third protective film 16 of the chip resistor. First protective film 13 and third protective film 16 are then integrally formed.

(Plating Step)

Figure 4C:
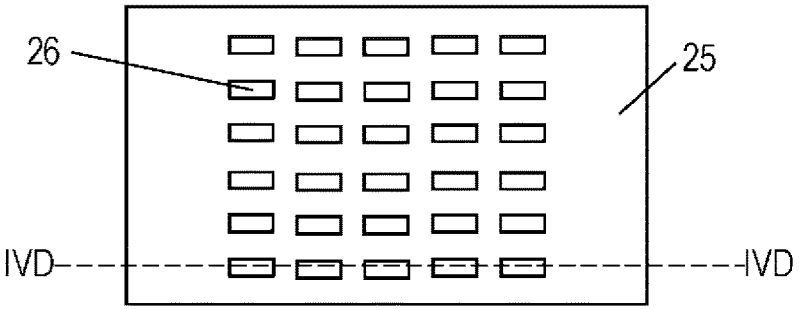
FIG. 4C is a top view indicating a plating step in the method for producing the chip resistor.
Figure 4D:
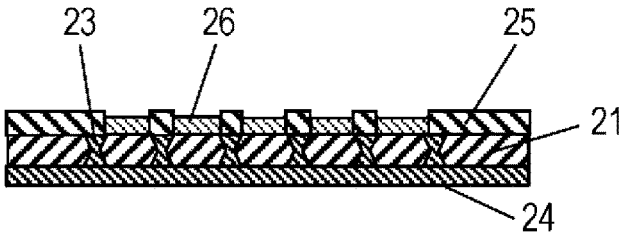
FIG. 4D is a cross-sectional view indicating the plating step.

In the method for producing the chip resistor, a top view indicating the plating step is illustrated in FIG. 4C, and a cross-sectional view indicating the plating step is illustrated in FIG. 4D. FIG. 4D is a cross-sectional view taken along line IVD-IVD in FIG. 4C Next, as illustrated in FIG. 4C and FIG. 4D, another resist 25 is pasted on the upper surface of sheet-shaped resistance member 21, and the plating is performed on the upper surface of sheet-shaped resistance member 21. At this time, patterning is performed on resist 25 such that an exposed part in each portion between grooves 23 in sheet-shaped resistance member 21 is formed into an island shape. Cu plating is then performed, and resist 25 is removed. As a result, a plurality of electrodes 26 formed by the Cu plating are formed in the portions between adjacent grooves 23 with uniform intervals.

(Polishing Step)

Figure 5A:
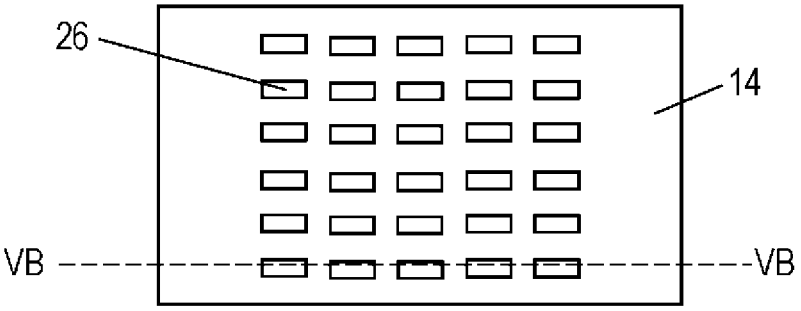
FIG. 5A is a top view indicating a polishing step in the method for producing the chip resistor.
Figure 5B:
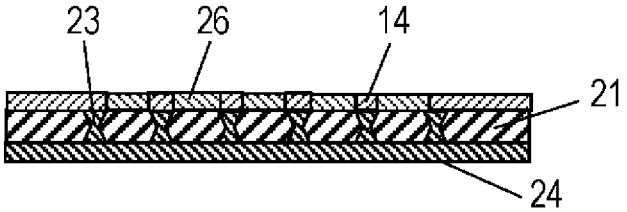
FIG. 5B is a cross-sectional view indicating the polishing step.

In the method for producing the chip resistor, a top view indicating the polishing step is illustrated in FIG. 5A, and a cross-sectional view indicating the polishing step is illustrated in FIG. 5B. FIG. 5B is a cross-sectional view taken along line VB-VB in FIG. 5A.

Next, as illustrated in FIG. 5A and FIG. 5B, second protective film 14 is formed between the plurality of electrodes 26. This second protective film 14 is formed of an epoxy resin. In other words, second protective film 14 is formed to cover portions between the plurality of electrodes 26 and upper surfaces of the plurality of electrodes 26, and then is cured. Thereafter, second protective film 14 is polished until the plurality of electrodes 26 are exposed.

(Individualizing Step)

Figure 5C:
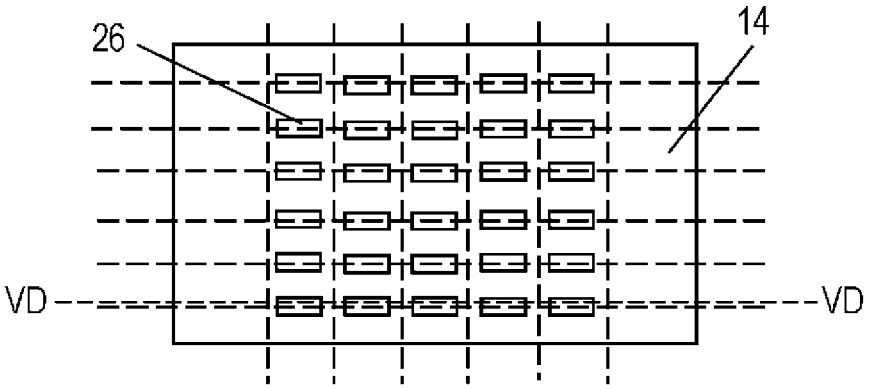
FIG. 5C is a top view indicating an individualizing step in the method for producing the chip resistor.
Figure 5D:
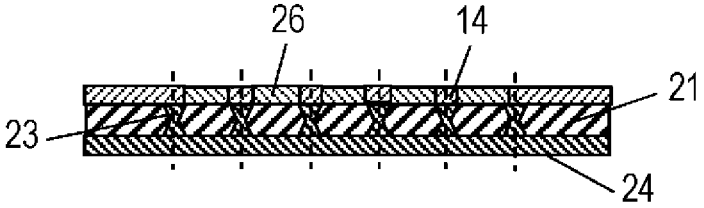
FIG. 5D is a cross-sectional view indicating the individualizing step.

In the method for producing the chip resistor, a top view indicating an individualizing step is illustrated in FIG. 5C, and a cross-sectional view indicating the individualizing step is illustrated in FIG. 5D. FIG. 5D is a cross-sectional view taken along line VD-VD in FIG. 5C.

Next, as illustrated in FIG. 5C and FIG. 5D, centers of grooves 23 and centers of the plurality of electrodes 26 (along broken lines in FIG. 5C and FIG. 5D) are cut to form individual pieces. The plurality of electrodes 26 serve as the pair of electrodes 12 of a single chip resistor thus individualized.

Finally, plated layer 15 is formed by performing Cu plating, Ni plating, and Sn plating from the upper surfaces of the pair of electrodes 12 of the chip resistor divided into the individual piece to end surfaces 11*c* of resistance member 11 to obtain the individualized chip resistor as illustrated in FIG. 1 and FIG. 2.

Note that, in order to simplify the description, FIG. 3A to FIG. 5D illustrate a portion where twelve grooves 23 and the individualized chip resistors of five vertical rows and four horizontal rows are formed as a sheet.

In addition, a resistance value may be adjusted as appropriate. When adjusting the resistance value, first protective film 13 is cut together with resistance member 11 by a laser beam to form a trimming groove. This can suppress generation of burrs. Another protective film is then formed to cover at least the trimming groove.

(3) Effects

In the chip resistor according to the exemplary embodiment of the present disclosure, side surface 11*d* of resistance member 11 is provided with protrusion 17 that protrudes outward when viewed along the current flowing direction. This configuration increases a contact area between third protective film 16 covering this protrusion 17 and side surface 11*d* of resistance member 11. This makes it difficult for third protective film 16 to be peeled off, thereby preventing resistance member 11 from being exposed from third protective film 16. In addition, an effect of maintaining long-term reliability can be achieved.

In other words, protrusion 17 increases an area of side surface 11*d* of resistance member 11, and also allows resistance member 11 to be resistant to stress in a vertical direction.

Furthermore, protective member 24 to be third protective film 16 is filled inside grooves 23 in sheet-shaped resistance member 21. This allows third protective film 16 to be reliably filled inside grooves 23. This makes it difficult for third protective film 16 to be peeled off.

In other words, third protective film 16 invades grooves 23 (side surface 11*d* of resistance member 11). Thus, third protective film 16 is easily covered completely.

Third protective film 16 and first protective film 13 are integrally formed at the same time, making it difficult for third protective film 16 to be peeled off from resistance member 11, upon cutting.

Protrusion 17 is formed on side surface 11*d* of resistance member 11, and third protective film 16 is formed on side surface 11*d* of resistance member 11. Then, the pair of electrodes 12 (26) are formed. This can prevent plating from growing around side surface 11*d* of resistance member 11 upon forming the pair of electrodes 12, thereby stabilizing a resistance value.

Third protective film 16 is filled inside groove 23, thereby reducing a level difference between an upper surface of third protective film 16 formed in groove 23 and an upper surface of resistance member 11. This can reduce a step height at a portion where second protective film 14 is formed to prevent exposure of resistance member 11.

(4) First Modification of Chip Resistor

Figure 6:
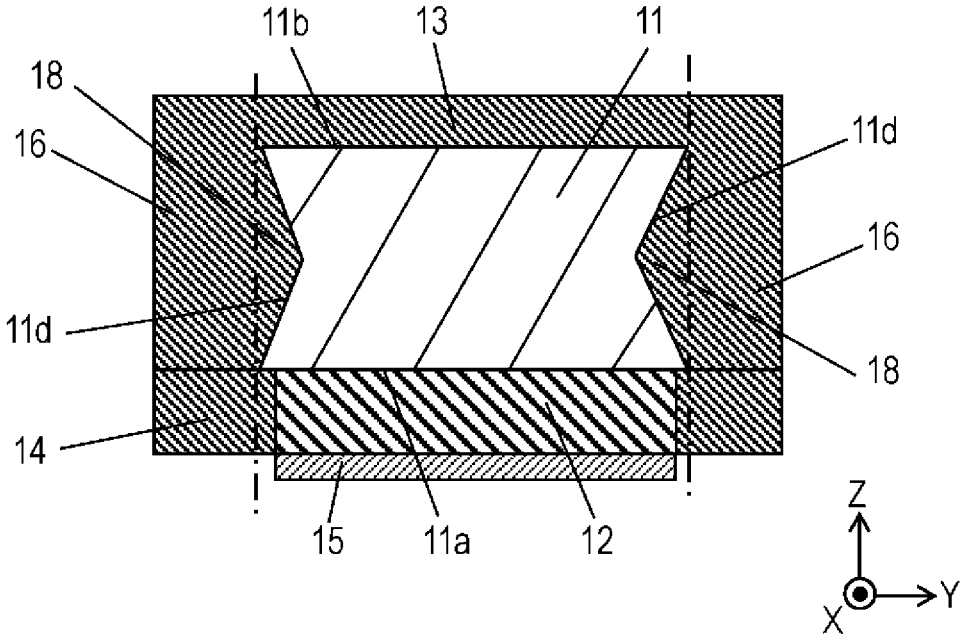
FIG. 6 is a side view of a first modification of the chip resistor.

In the exemplary embodiment described above, protrusion 17 is formed on side surface 11*d* of resistance member 11. However, when viewed along a current flowing direction (X-axis direction; lateral direction), recess 18 that is recessed from other portions in side surface 11*d* of resistance member 11 may be formed, as illustrated in FIG. 6. In other words, recess 18 is inwardly recessed from a plane formed by connecting an edge of first main surface 11*a* and an edge of second main surface 11*b* (a plane parallel to an X-Z plane), along a direction orthogonal to the current flowing direction (Y-axis direction; longitudinal direction). Side surface 11*d* of resistance member 11 including recess 18 is covered by third protective film 16.

Similar to protrusion 17, recess 18 thus formed increases a contact area between third protective film 16 covering this recess 18 and side surface 11*d* of resistance member 11. This makes it difficult for third protective film 16 to be peeled off. Therefore, resistance member 11 can be prevented from being exposed from third protective film 16, and long-term reliability can thus be maintained.

Upon etching upper and lower surfaces of sheet-shaped resistance member 21 illustrated in FIG. 3C and FIG. 3D, this recess 18 is formed by making a time period for etching longer than a time period for forming protrusion 17. When the time period for etching is made longer, a protruding portion in protrusion 17 is eroded. A central portion of side surface 11*d* that is exposed to an etching liquid from the upper and lower surfaces is further eroded.

Dimensions and materials of the chip resistor according to this first modification are the same as those of the chip resistor illustrated in FIG. 1. Note that, recess 18 is recessed along the Y direction from the plane formed by connecting the edge of first main surface 11*a* and the edge of second main surface 11*b* by 0.02 mm. In FIG. 6, each recess 18 corresponds to a portion on the inner side of the alternate long and short dash line (a part of a plane connecting the edge of first main surface 11*a* and the edge of second main surface 11*b*).

Note that the chip resistor is not necessarily limited to those dimensions and materials.

Figure 12A:
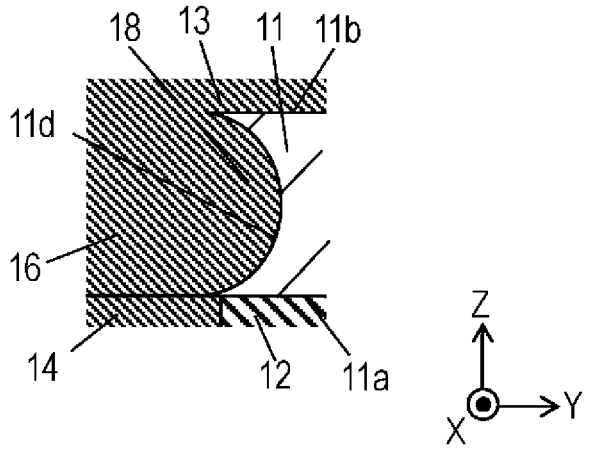
FIG. 12A is a cross-sectional view of a portion near a recess of yet another modification of the chip resistor.
Figure 12B:
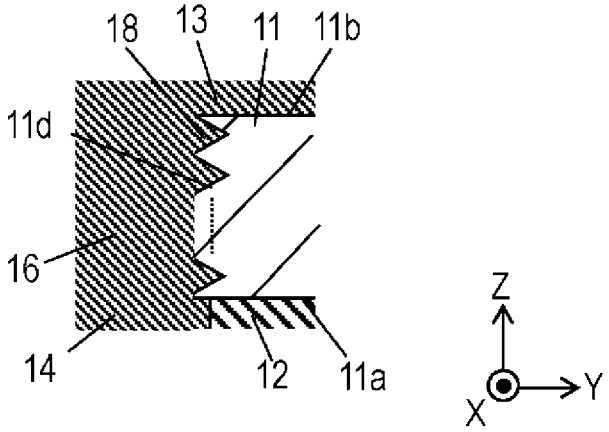
FIG. 12B is a cross-sectional view of a portion near a recess of yet another modification of the chip resistor.
Figure 12C:
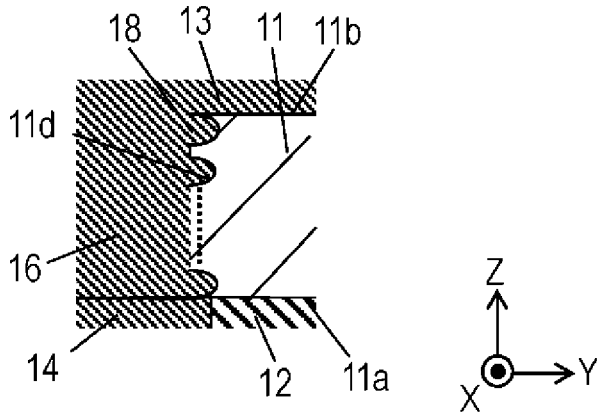
FIG. 12C is a cross-sectional view of a portion near a recess of yet another modification of the chip resistor.

Note that, recess 18 may have a hemispherical side-surface shape as in a modification illustrated in FIG. 12A, may have a plurality of triangular pyramidal recesses as in a modification illustrated in FIG. 12B, or may have a plurality of hemispherical recesses as in a modification illustrated in FIG. 12C. Recess 18 may have a columnar side-surface shape in place of the hemispherical side-surface shape described above. A shape of each of the plurality of recesses serving as recess 18 may be a pyramid such as a quadrangular pyramid, a cone, a prism, or a column. Intervals between the plurality of recesses can be selected as appropriate. When a plurality of recesses 18 are provided, their shapes or sizes are not necessarily uniform, and may be arbitrary. Note that each of FIGS. 12A, 12B, and 12C is an enlarged cross-sectional view of a portion near recess 18 according to another modification of resistance member 11.

(5) Second Modification of Chip Resistor

Figure 7:
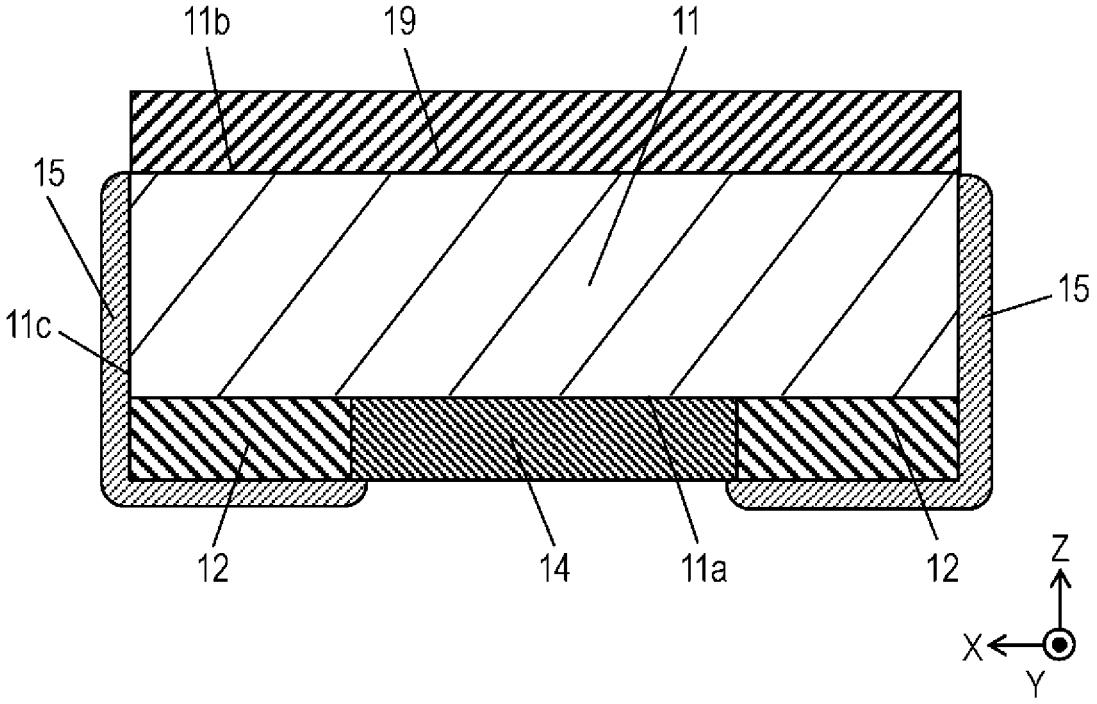
FIG. 7 is a cross-sectional view of a second modification of the chip resistor.
Figure 8:
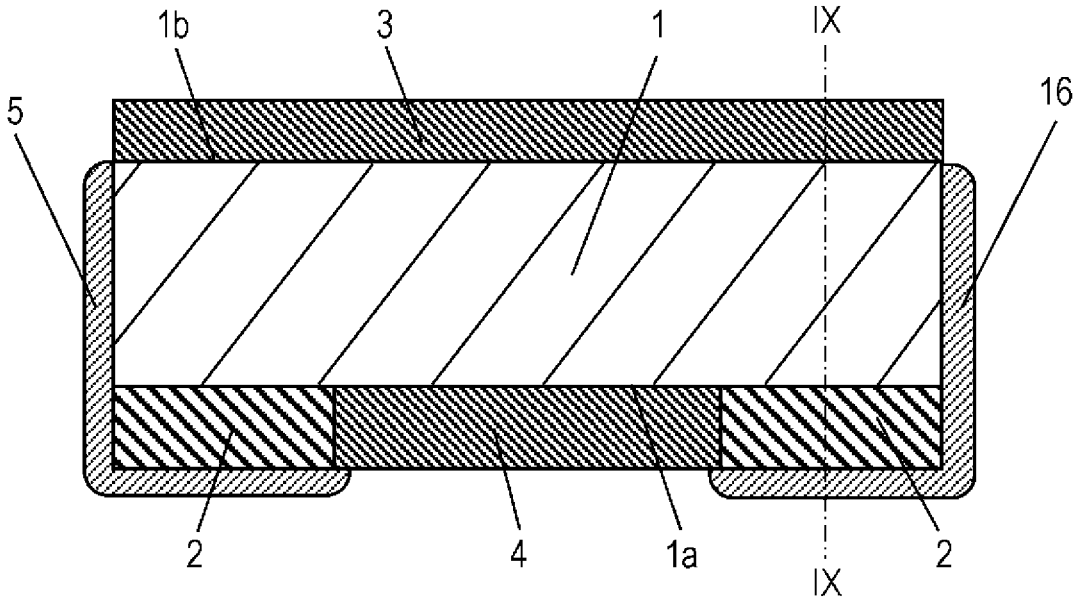
FIG. 8 is a side view of a conventional chip resistor.
Figure 9:
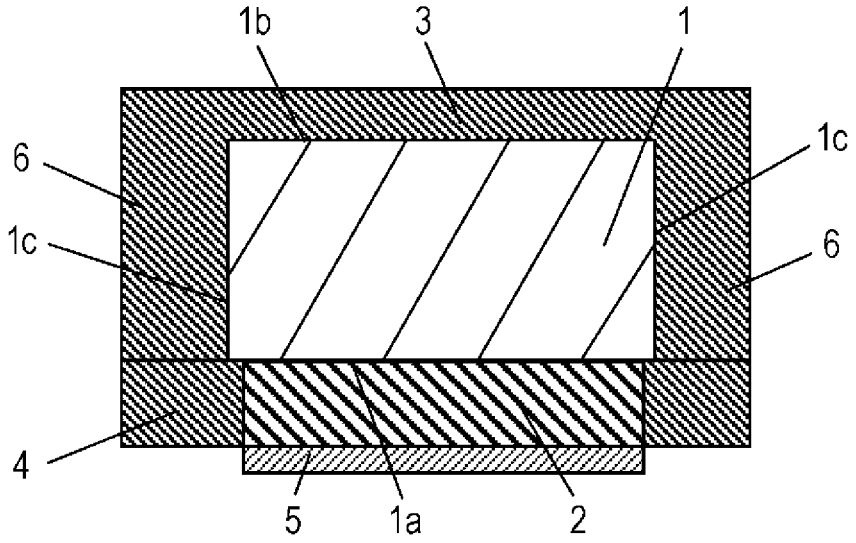
FIG. 9 is a cross-sectional view of the conventional chip resistor.

In the exemplary embodiment described above, first protective film 13 is formed on second main surface 11*b* of resistance member 11, but resin substrate 19 in place of first protective film 13 may be pasted on second main surface 11*b* of resistance member 11, as illustrated in FIG. 7. Alternatively, resin substrate 19 may be formed on an upper surface of first protective film 13.

This resin substrate 19 is thicker than first protective film 13, and is formed of glass epoxy that is the same material as a material used for the mounting substrate. When resin substrate 19 is directly formed on resistance member 11, resin substrate 19 and resistance member 11 are bonded by thermocompression bonding.

Resin substrate 19 improves resistance to bending stress of the chip resistor, and hence facilitates conveyance of the chip resistor within production processes. Further, solder crack caused by a difference in coefficient of thermal expansion between a mounted chip resistor and a mounting substrate can be prevented. Note that, first protective film 13 may further be formed on an upper surface of resin substrate 19.

A chip resistor and a method for producing the chip resistor according to the present disclosure have an effect of suppressing degradation of long-term reliability. The present disclosure is useful when applied to chip resistor or other components, which is used in various electronic devices and which uses a metal plate as resistance member.

The invention claimed is:

1. A chip resistor comprising:
a resistance member;
a pair of electrodes;
a first protective film;
a second protective film; and
a third protective film,
wherein the resistance member includes
a first main surface,
a second main surface located on a side opposite to the first main surface, and
a protrusion that protrudes outward from a plane connecting an edge of the first main surface and an edge of the second main surface,
the pair of electrodes are respectively disposed on both ends of the first main surface of the resistance member, and a direction connecting respective ones of the pair of electrodes is a direction along the edge of the first main surface and the edge of the second main surface,
the first protective film is disposed on the second main surface of the resistance member,
the second protective film is disposed on the first main surface of the resistance member and between the pair of electrodes, and
the third protective film is disposed on the protrusion of the resistance member.

2. The chip resistor according to claim 1, wherein the first protective film is disposed of a resin substrate.

3. A chip resistor comprising:
a resistance member;
a pair of electrodes;
a first protective film;
a second protective film; and
a third protective film,
wherein the resistance member includes
a first main surface,
a second main surface located on a side opposite to the first main surface, and
a recess that recesses inward from a plane connecting an edge of the first main surface and an edge of the second main surface,
the pair of electrodes are respectively disposed on both ends of the first main surface of the resistance member, and a direction connecting respective ones of the pair of electrodes is a direction along the edge of the first main surface and the edge of the second main surface,
the first protective film is disposed on the second main surface of the resistance member,
the second protective film is disposed on the first main surface of the resistance member and between the pair of electrodes, and
the third protective film is disposed on the recess of the resistance member.

4. The chip resistor according to claim 3, wherein the first protective film is disposed of a resin substrate.

5. A method for producing a chip resistor comprising:
a step of forming a plurality of grooves on a main surface of a sheet-shaped resistance member and a rear surface located on a side opposite to the sheet-shaped resistance member when viewed from the main surface;
a step of forming a protective member on the main surface of the sheet-shaped resistance member and inside the plurality of grooves in an integrated manner;
a step of forming a plurality of electrodes between the grooves that are adjacent to each other at uniform intervals, by pasting a resist on the rear surface of the sheet-shaped resistance member, and performing plating on the rear surface of the sheet-shaped resistance member; and
a step of cutting centers of the plurality of grooves and centers of the plurality of electrodes to divide the sheet-shaped resistance member into individual pieces.

6. The method for producing a chip resistor according to claim 5, wherein in the step of forming the plurality of electrodes, the plurality of grooves are formed in the sheet-shaped resistance member, by pasting a resist on the main surface and the rear surface of the sheet-shaped resistance member, performing etching on both the main surface and the rear surface of the sheet-shaped resistance member, and then removing the resist.

* * * * *